US009990793B2

(12) United States Patent
Wilson et al.

(10) Patent No.: US 9,990,793 B2
(45) Date of Patent: Jun. 5, 2018

(54) MEDIA ITEM SEPARATION

(71) Applicant: NCR CORPORATION, Duluth, GA (US)

(72) Inventors: Owen Wilson, Kitchener (CA); Frank Dunn, Waterloo (CA); Jason Gillier, Waterloo (CA)

(73) Assignee: NCR Corporation, Atlanta, GA (US)

( * ) Notice: Subject to any disclaimer, the term of this patent is extended or adjusted under 35 U.S.C. 154(b) by 53 days.

(21) Appl. No.: 13/955,713

(22) Filed: Jul. 31, 2013

(65) Prior Publication Data

US 2015/0035222 A1 Feb. 5, 2015

(51) Int. Cl.
*G07D 11/00* (2006.01)

(52) U.S. Cl.
CPC ..... *G07D 11/0021* (2013.01); *G07D 11/0018* (2013.01)

(58) Field of Classification Search
CPC ..... B65H 3/5223; B65H 3/56; B65H 3/5261; B65H 3/5246; B65H 2701/1912; G07D 11/0084; G07D 11/0081; G07D 7/00; G07D 7/12; G07F 7/04
USPC ..... 271/10.03, 121, 122, 125, 258.01, 262, 271/263, 265.04, 902; 194/206, 207; 209/534
See application file for complete search history.

(56) References Cited

U.S. PATENT DOCUMENTS

| | | | | | |
|---|---|---|---|---|---|
| 4,316,606 | A * | 2/1982 | Buys | B65H 3/5261 | 271/10.04 |
| 4,494,747 | A * | 1/1985 | Graef | B65H 3/0638 | 221/21 |
| 4,958,825 | A * | 9/1990 | Onomoto | B65H 3/0661 | 271/119 |
| 5,711,518 | A * | 1/1998 | Portaro | B65H 3/063 | 271/10.11 |
| 5,901,951 | A * | 5/1999 | Yamaguchi | B65H 3/5261 | 271/10.11 |
| 7,140,607 | B2 * | 11/2006 | Graef et al. | 271/122 | |
| 2008/0116032 | A1 * | 5/2008 | Chang et al. | 194/206 | |
| 2013/0241138 | A1 * | 9/2013 | Chen et al. | 271/109 | |

* cited by examiner

*Primary Examiner* — Thomas A Morrison
(74) *Attorney, Agent, or Firm* — Schwegman Lundberg & Woessner

(57) ABSTRACT

The present invention provides a method and apparatus for separating a media item from a bunch of media items. The apparatus comprises at least one first roller located on a first side of a transport path along which a media item is transported and at least two further rollers located on a further side of the transport path opposite the first side, said at least two further rollers being spaced apart to receive a portion of said at least one first roller therebetween, wherein in an advance mode of operation said first and further rollers rotate in the same direction and in a reject mode of operation said first and further rollers rotate in opposite directions.

15 Claims, 8 Drawing Sheets

MEDIA ITEM SEPARATION

FIELD OF THE INVENTION

The present invention relates to a method and apparatus for transporting media items along a transport path. In particular, but not exclusively, the present invention relates to separating media items from a bunch of media items so that the separated media items can be individually transported along a transport path of a media item processing module.

Various situations are known in which a bunch of media items are transported along a transport pathway in a Self-Service Terminal (SST). It is known for a transport mechanism to receive a bunch of media items and transport the bunch along a transport path into the SST for processing. In certain modes of operation of the SST, it is also known for one or more media items to be removed from or added to the bunch of media items before each media item advances through the ATM for processing. Such media items may take the form of checks, currency notes, vouchers, coupons, tokens, or the like.

Problems exist when separating a media item from a bunch of media items. In particular, more than one media item may accidentally be removed from a bunch of media items at the same time which can cause errors to occur. For example, media jams can occur or the media items may be damaged as the media items are being transported and processed within the ATM. The cause of more than one media items being removed from a bunch at the same time is often a result of media items in the bunch adhering together as a result of certain characteristics of the media items making it difficult for a media item separator of the ATM to separate single media items from the bunch. For example, certain media items may have a relatively rough texture, they may be relatively sticky, or they may be relatively new.

SUMMARY OF THE INVENTION

It is an aim of the present invention to at least partly mitigate the above-mentioned problems.

It is an aim of certain embodiments of the present invention to provide a method and apparatus for separating a media item from a bunch of media items.

It is an aim of certain embodiments of the present invention to provide a method and apparatus for removing a single media item from a bunch of media items and detecting when more than one media item has been erroneously removed from the bunch of media items.

It is an aim of certain embodiments of the present invention to provide a method and apparatus for returning more than one media item which has been erroneously removed from a bunch of media items to the bunch of media items for reprocessing.

It is an aim of certain embodiments of the present invention to provide a method and apparatus for separating a media item from a bunch of brand new media items.

It is an aim of certain embodiments of the present invention to provide a method and apparatus for separating a media item from a bunch of media items whilst ensuring wear of the apparatus is kept to a minimum.

According to a first aspect of the present invention there is provided apparatus for separating a media item from a bunch of media items, comprising:

at least one first roller located on a first side of a transport path along which a media item is transported; and at least two further rollers located on a further side of the transport path opposite the first side, said at least two further rollers being spaced apart to receive a portion of said at least one first roller therebetween; wherein in an advance mode of operation said first and further rollers rotate in the same direction and in a reject mode of operation said first and further rollers rotate in opposite directions.

Aptly, a parameter associated with the at least one first roller is greater than a corresponding parameter associated with the at least two further rollers.

Aptly, each of the first and further rollers provides a respective media item contact surface and said parameter comprises a coefficient of friction of the respective contact surfaces.

Aptly, each of the first and further rollers provides a respective media item contact surface and said parameter comprises a contact area of the respective contact surfaces.

Aptly, the apparatus further comprises:

said at least one first roller comprises a first set of spaced apart rollers rotatable about a first common axis; and said at least two further rollers comprise a further set of spaced apart rollers rotatable about a further common axis; wherein the first common axis is substantially parallel with and spaced apart from the further common axis and a combined media item contact surface of said first set of rollers is set apart from a corresponding combined media item contact surface of said further set of rollers.

Aptly, said first set of rollers is staggered with respect to said further set of rollers so that rollers of the first and further sets of rollers mesh together to deform media items transported therebetween.

Aptly, the apparatus further comprises:

a slotted opening in a housing to at least partially receive a plurality of media items of a bunch of media items, the slotted opening comprising opposed and spaced apart first and further lip portions; wherein at least a one of said first and further lip portions is tapered inwardly with respect to the slotted opening to partially separate and guide a media item when the bunch of media items is urged towards said housing.

Aptly, the apparatus further comprises:

a one of the first and further lip portions comprises at least one first protrusion extending into the slotted opening and a remainder one of the first and further lip portions comprises at least two further protrusions extending into the slotted opening; wherein the at least two further protrusions are spaced apart in a staggered pattern with respect to the at least one first protrusion.

Aptly, the apparatus further comprises:

at least one transfer roller for transferring a separated media item away from the first and further rollers, wherein said transfer roller is located downstream of the first and further rollers with respect to a transport path along which a separated media item is transported.

Aptly, the apparatus further comprises:

at least one sensor for sensing when a plurality of media items have been separated simultaneously from the bunch of media items; and a controller that selectively rotates said first roller in an opposite direction to said further rollers responsive to said at least one sensor to return the plurality of media items to the bunch of media items in said reject mode of operation.

According to a second aspect of the present invention there is provided a media item processing module comprising apparatus in accordance with the first aspect of the present invention.

According to a third aspect of the present invention there is provided a Self-Service Terminal (SST) comprising a media item processing module in accordance with the second aspect of the present invention.

According to a fourth aspect of the present invention there is provided a method of separating a media item from a bunch of media items, comprising:

in an advance mode of operation, rotating at least one first roller, located on a first side of a transport path along which a media item is transported and at least two further rollers located on an opposite side of the transport path and spaced apart to receive a portion of said at least one first roller therebetween, in a same direction, the further side of the transport path being opposite the first side; and in a reject mode of operation, rotating said first and further rollers in opposite directions.

Aptly, the method further comprises:

via said at least one first roller, separating a media item from a bunch of media items; and urging said media item over said further rollers and along said transport path; wherein said at least one first roller comprises a media item contact surface having a greater coefficient of friction than a corresponding media item contact surface of said further rollers.

Aptly, the method further comprises:

deforming a plurality of media items located on a transport path between said first and further rollers; and separating a media item from said plurality of media items.

Aptly, the method further comprises:

urging a bunch of media items against a tapered lip portion of a slotted opening in a housing to partially advance at least one media item of said bunch of media items into said opening and towards the first and further rollers.

Aptly, the method further comprises:

sensing a plurality of media items simultaneously separated from a bunch of media items being moved together downstream of said first and further rollers with respect to the transport path; and reversing a direction of rotation of said first roller so that said at least one first roller rotates in a different direction to said further rollers to thereby return the sensed plurality of media items to the bunch of media items in said reject mode of operation.

According to a fifth aspect of the present invention there is provided a method of separating a media item from a bunch of media items, comprising:

via a first drive member rotating in a first direction, advancing a one media item from a bunch of media items; and via a further drive member rotating in the first direction, substantially preventing any advancement of a remaining media item advanced from the bunch with said a one media item.

Certain embodiments of the present invention provide a method and apparatus for separating a media item from a bunch of media items and advancing the media item along a transport path of a media item processing module for further processing.

Certain embodiments of the present invention provide the advantage of removing a media item from a bunch of media items whilst detecting if more than one media item has been erroneously removed from the bunch of media items.

Certain embodiments of the present invention provide the advantage of detecting if more than one media item has been erroneously removed from a bunch of media items and returning the erroneous media items to the bunch of media items for reprocessing.

Certain embodiments of the present invention provide a method and apparatus for separating a media item from a bunch of media items wherein each media item has a relatively high coefficient of friction such as brand new media items having a rough or sticky surface.

Certain embodiments of the present invention provide the advantage of separating a relatively limp media item from a bunch of relatively limp media items.

Certain embodiments of the present invention provide a method and apparatus for separating a media item from a bunch of media items whilst ensuring the wear and required maintenance of the apparatus is kept to a minimum.

BRIEF DESCRIPTION OF DRAWINGS

Embodiments of the present invention will now be described hereinafter, by way of example only, with reference to the accompanying drawings in which.

DESCRIPTION OF EMBODIMENTS

Figure 1:
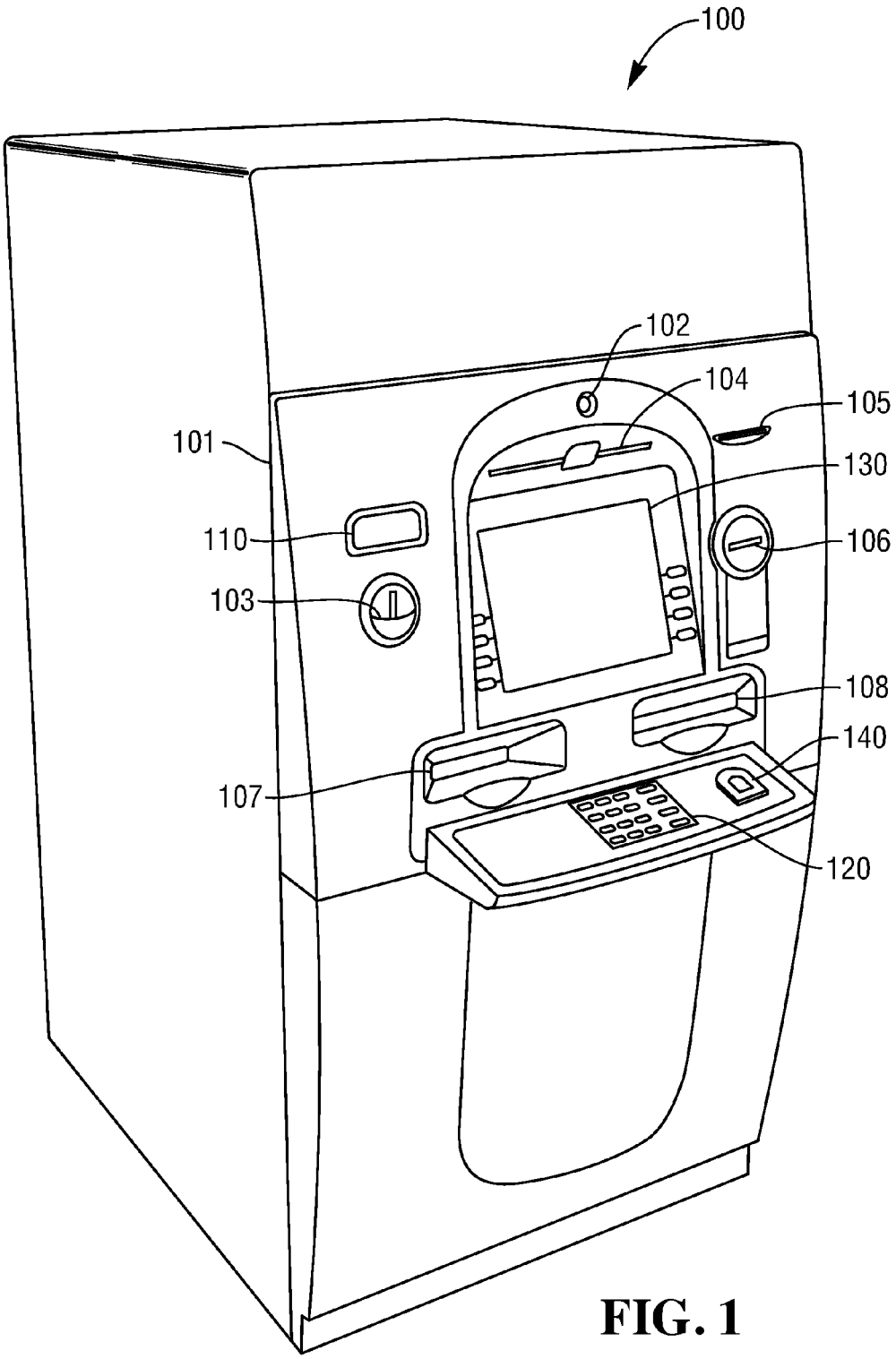
FIG. 1 illustrates an ATM according to an embodiment of the present invention.

In the drawings like reference numerals refer to like parts.

FIG. 1 illustrates a self-service check depositing terminal in the form of an image-based check depositing Automated Teller Machine (ATM) 100. It will be appreciated that certain embodiments of the present invention are applicable to a wide variety of terminals in which items of media such as checks and/or currency notes and/or giros and/or lottery tickets and/or other such flexible sheet-like items of media are to be transported and directed in different directions. The type of terminal will of course be appropriate for the type of items of media being transported.

As illustrated in FIG. 1, the ATM 100 includes a fascia 101 coupled to a chassis (not shown). The fascia 101 defines an aperture 102 through which a camera (not shown) images a customer of the ATM 100. The fascia 101 also defines a number of slots for receiving and dispensing media items and a tray 103 into which coins can be dispensed. The slots include a statement output slot 104, a receipt slot 105, a card reader slot 106, a cash slot 107, a further cash slot 108 and a check input/output slot 110. The slots and tray are arranged such that the slots and tray align with corresponding ATM modules mounted within the chassis of the ATM.

The fascia 101 provides a customer interface for allowing an ATM customer to execute a transaction. The fascia 101 includes an encrypting keyboard 120 for allowing an ATM customer to enter transaction details. A display 130 is provided for presenting screens to an ATM customer. A fingerprint reader 140 is provided for reading a fingerprint of an ATM customer to identify the ATM customer.

Within the chassis of the ATM it will be understood that items of media must be transported from time to time from one location to another. The pathway taken by any particular item of media is dependent upon an operation being carried out at the ATM and may also be dependent upon other factors such as whether a customer of the ATM is authorized and/or whether an item of media being transported satisfies certain pre-determined criteria.

Figure 2:
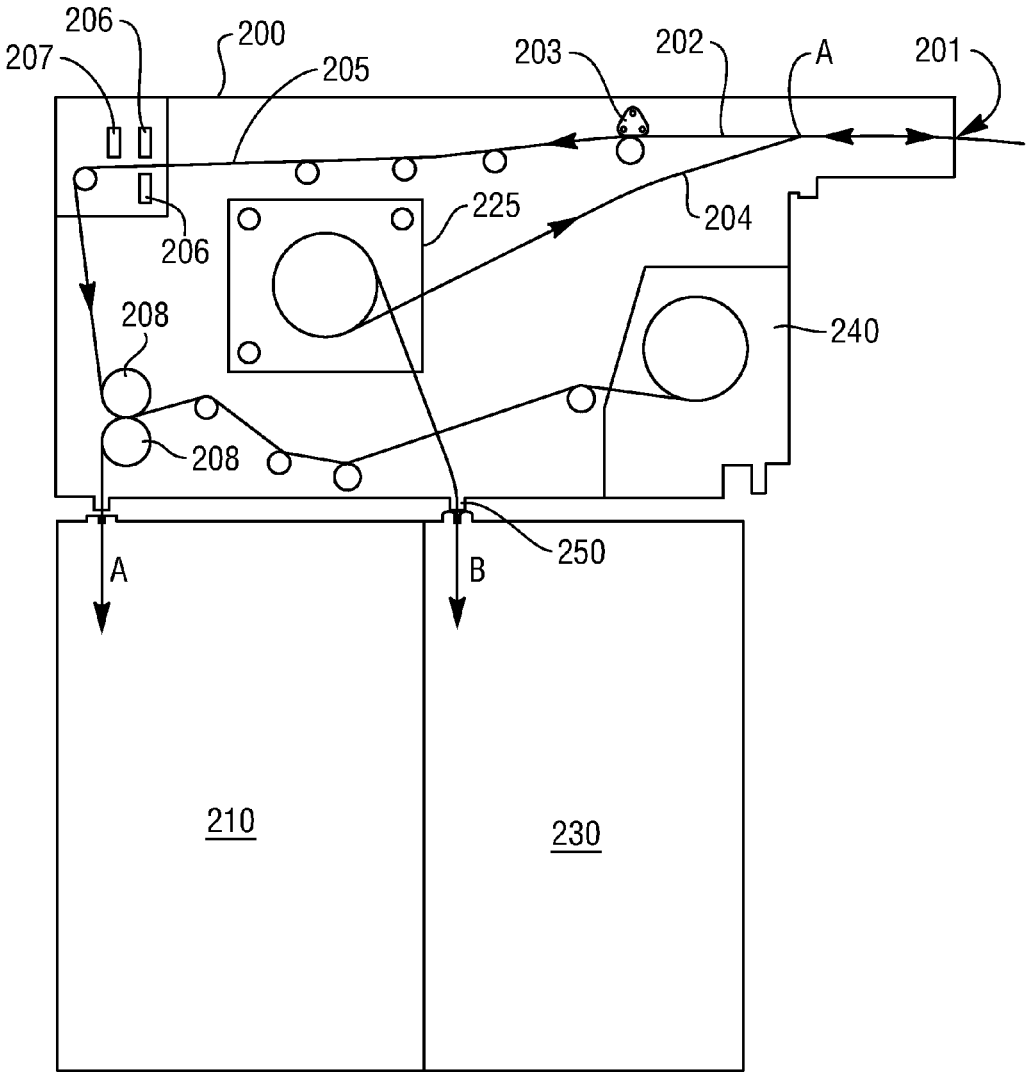
FIG. 2 illustrates transport pathways and modules within the ATM of FIG. 1 according to an embodiment of the present invention.

FIG. 2 illustrates possible transport pathways and internal modules within the ATM which can be utilized to process deposited checks. A check processing module 200 has an access mouth 201 through which incoming checks and/or currency notes are deposited or outgoing checks are dispensed. This mouth 201 is aligned with an infeed aperture in the ATM which thus provides an input/output slot 110. A bunch of one or more media items, such as currency notes or checks, is input or output. Aptly, a bunch of up to a hundred items, or more, can be received/dispensed. Incoming checks follow a first transport path 202 away from the mouth 201 in a substantially horizontal direction from right to left shown in FIG. 2. The first transport path 202 is also referred to as the infeed path. The checks then pass through a media item separator 203 and along another pathway portion 205 which is also substantially horizontal and right to left. The checks are then de-skewed and read by imaging cameras 206 and an MICR reader 207. Checks are then directed substantially vertically downwards to a point between two nip rollers 208. These nip rollers co-operate and are rotated in opposite directions with respect to each other to either draw deposited checks inwards (and urge those checks towards the right hand side in FIG. 2), or during another mode of operation, the rollers can be rotated in an opposite fashion to direct processed checks downwards in the direction shown by arrow A in FIG. 2 into a check bin 210. Incoming checks which are moved by the nip rollers 208 towards the right can either be diverted upwards (in FIG. 2) into a re-buncher unit 225, or downwards in the direction of arrow B in FIG. 2 into a cash bin 230, or to the right hand side shown in FIG. 2 into an escrow 240. Checks from the escrow can be directed to the re-buncher 225 or downwards into the cash bin 230. Checks can be reprocessed or returned to a customer via a further transport path 204, also known as the return path.

Figure 3:
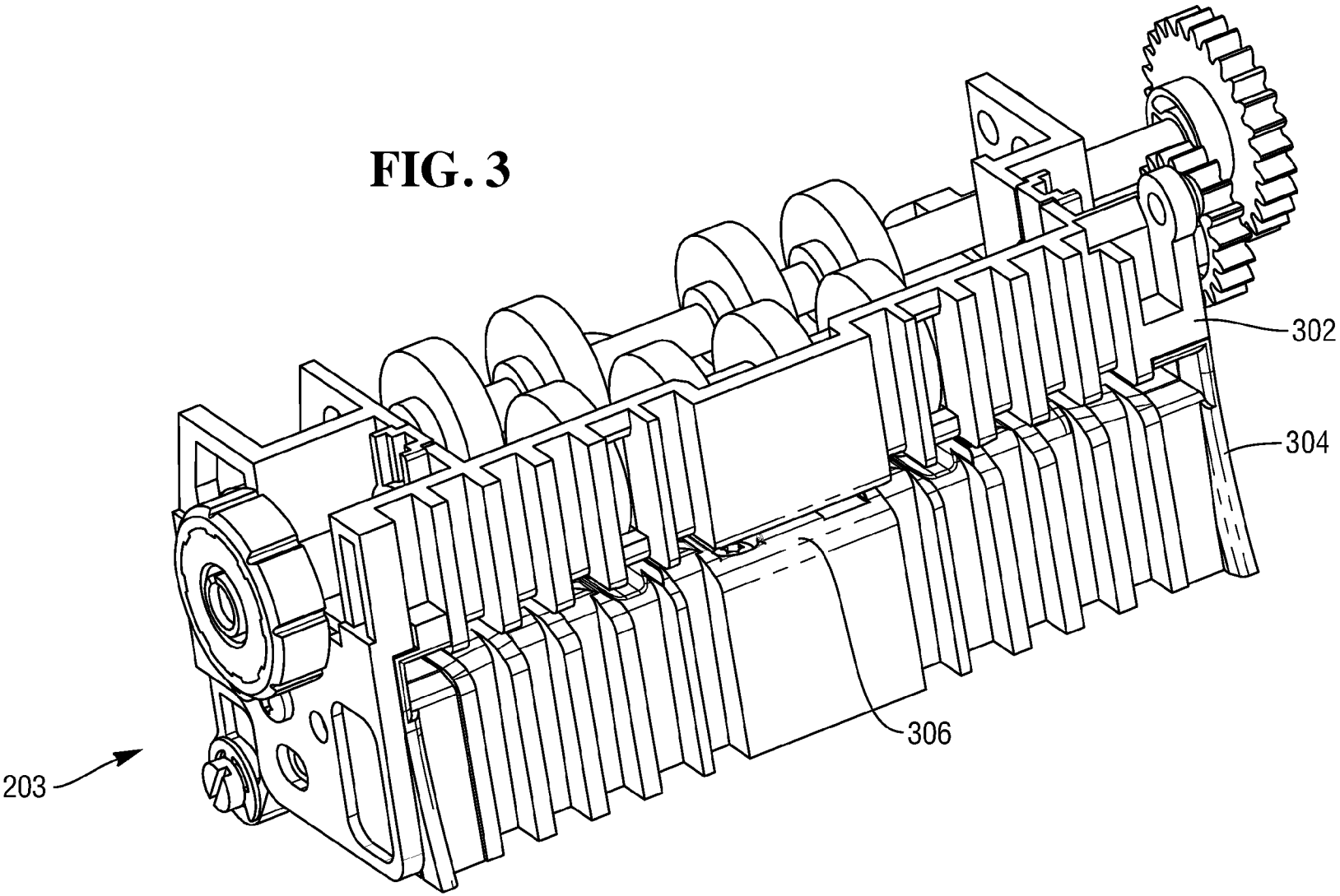
FIG. 3 illustrates a media item separator of the ATM of FIG. 2 according to an embodiment of the present invention.
Figure 4:
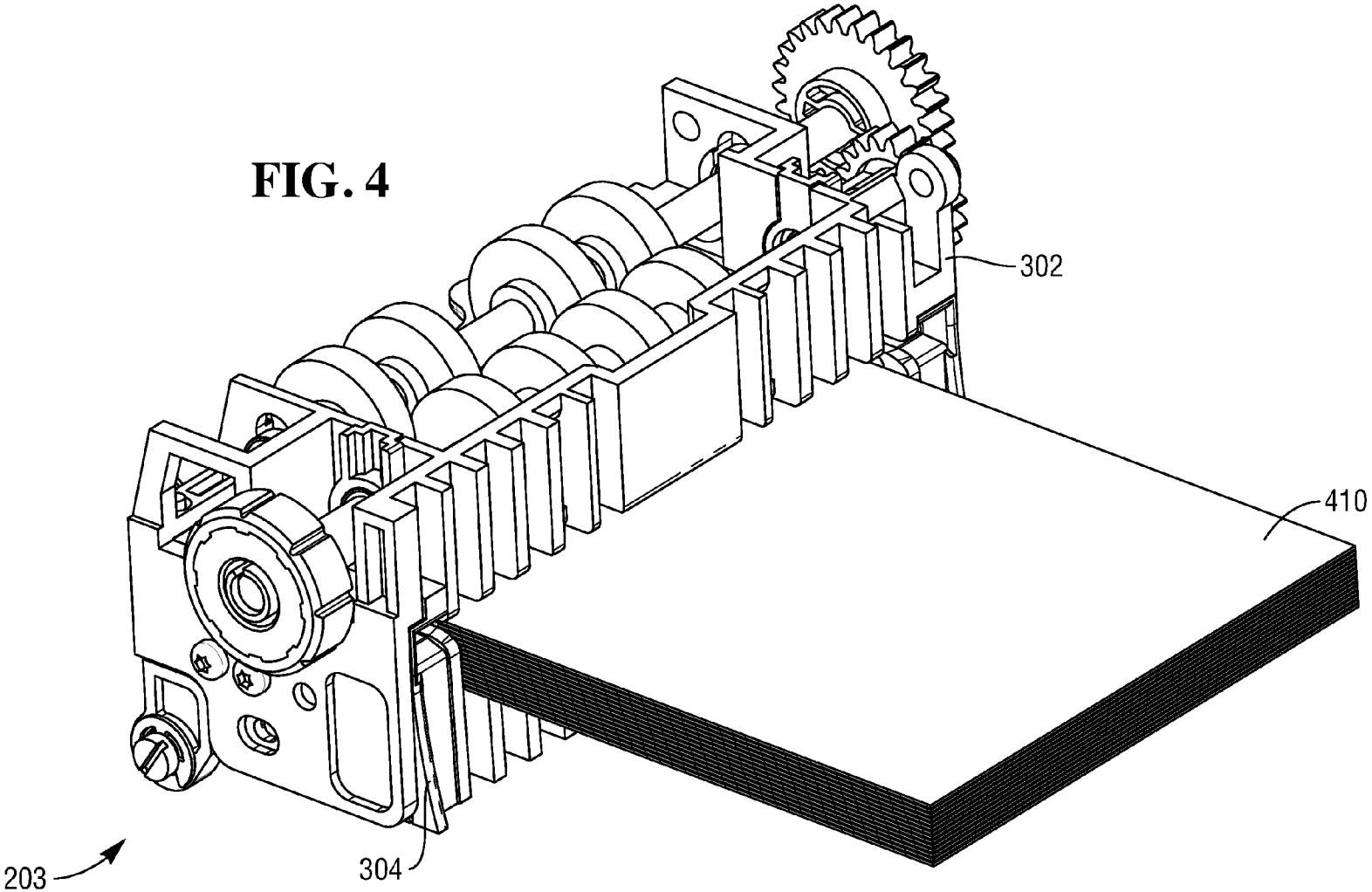
FIG. 4 illustrates the media item separator of FIG. 3 with a bunch of documents located at an opening of the separator.
Figure 5:
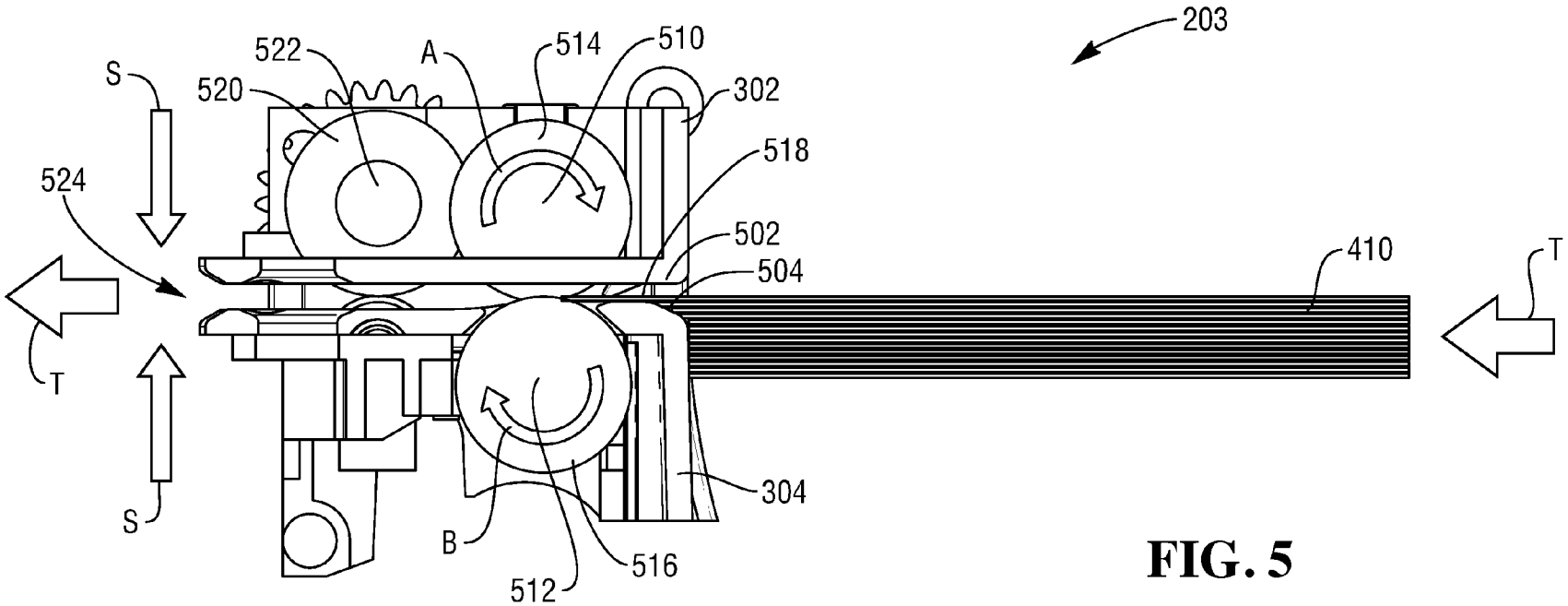
FIG. 5 illustrates a longitudinal cross-section through the media item separator of FIGS. 3 and 4 with respect to the transport path.
Figure 8:
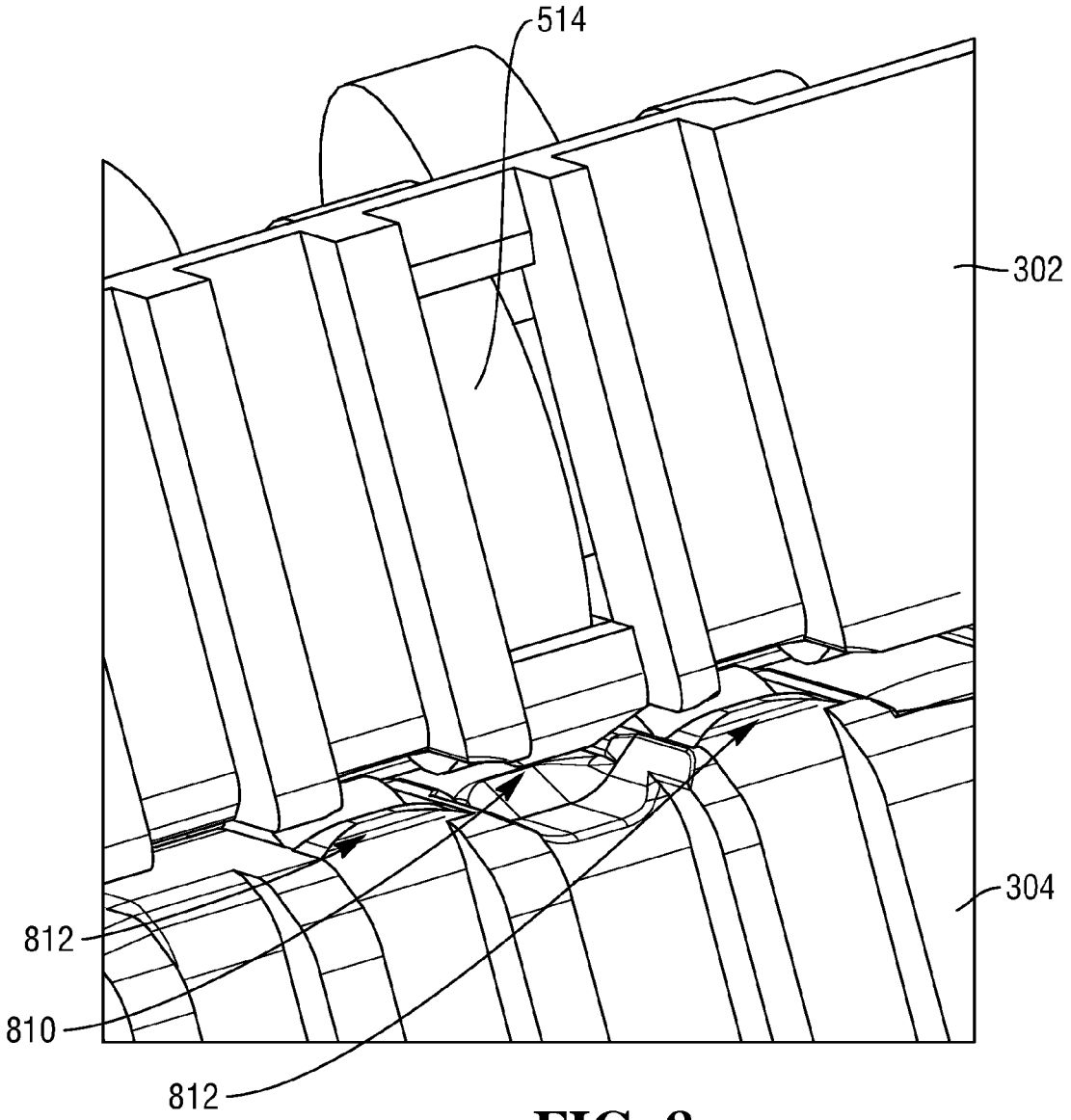
FIG. 8 illustrates detail of the mouth of the media item separator.

As illustrated in FIG. 3, the media item separator 203 according to certain embodiments of the present invention includes an upper housing portion 302, a lower housing portion 304 and an opening 306 located between the upper and lower housing portions 302, 304 for at least partially receiving media items of a bunch of media items 410 as shown in FIG. 4. Such media items may include checks, currency notes, vouchers, tokens, coupons, or the like. As best shown in FIGS. 5 and 8, respective edges 502, 504 of the upper and lower housing portions 302, 304 are tapered to guide media items from a bunch of media items 410 into the media item separator 203 via the opening 306. This allows splaying of the bunch 410 so that smaller amounts of media items 518 are presented to the separator 203 allowing for higher separation efficiency and fewer 'double feeds' as will be described in more detail below.

Figure 6:
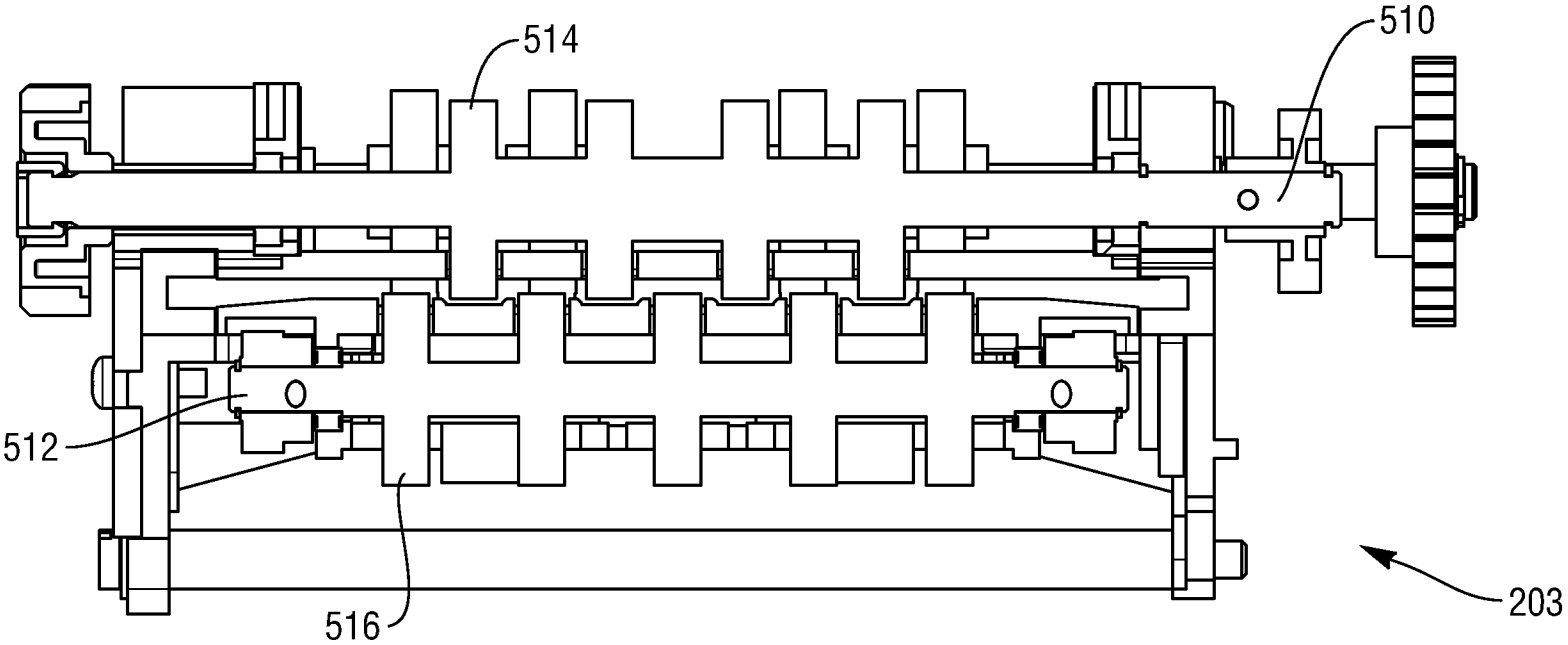
FIG. 6 illustrates a lateral cross-section through the media item separator of FIGS. 3 to 5 with respect to the transport path.
Figure 7:
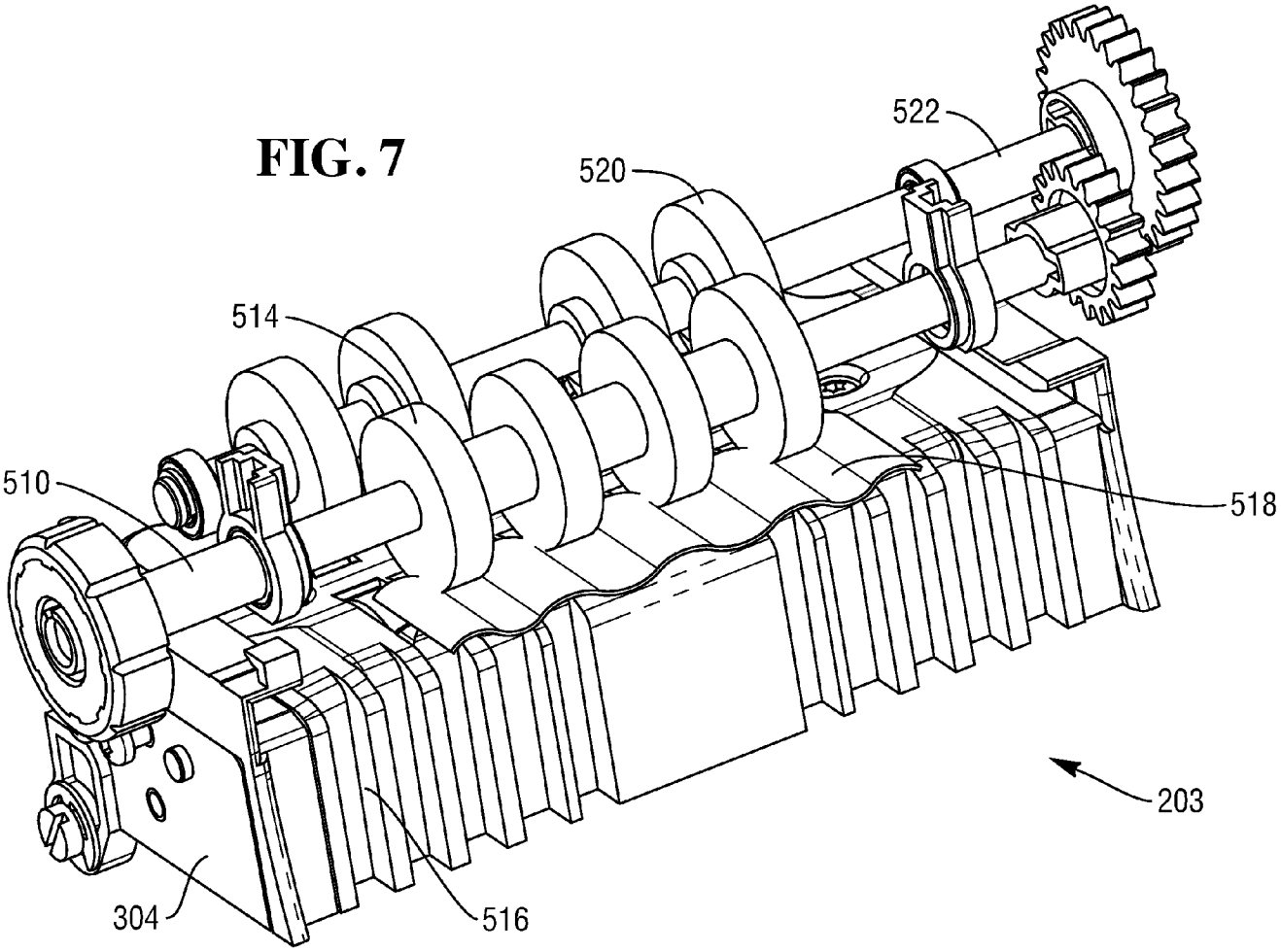
FIG. 7 illustrates a schematic of certain internal components of the media item separator of FIGS. 3 to 6 with a media item located between upper and lower rollers of the separator.

As best shown in FIG. 5, an advance roller shaft 510 is supported by the upper housing portion 302 and a retard roller shaft 512 is supported by the lower housing portion 304. The advance roller shaft 510 supports a number of spaced apart advance rollers 514 and the retard roller shaft 512 supports a number of spaced apart retarding rollers 516. As best shown in FIG. 6, the advance rollers 514 are spaced apart from each other such that they are staggered with respect to the spaced apart retarding rollers 516. The advance drive shaft 510 is spaced apart from the retard drive shaft 512 such that a portion of each advance drive roller 514 is vertically received between a respective pair of retarding drive rollers 516. As can be seen in FIG. 6, the advance drive rollers 514 do not contact the retarding drive rollers 516. This has the effect of slightly deforming media items 518 of the bunch 410 which have been urged towards the rollers 514, 516 via the opening 306. The media items 518 are deformed into a wave profile by the rollers 514, 516 as shown in FIG. 6 which is effective for providing stiffness to the media items 518 and effective 'pinch force' during separation of a top media item from the media items 518 as described further below.

Respective media item contact surfaces of the retard rollers 516 have a coefficient of friction which is less than respective media item contact surfaces of the advance rollers 514 to allow a media item to be urged from right to left along the transport path T by the advance rollers 514 whilst not being urged in the opposite direction back towards the bunch 410 by the retard rollers 516. The different coefficients of friction may be provided by different materials of the respective media item contact surfaces of the advance and retard rollers 514, 516 and/or by different contact areas of the respective media item contact surfaces of the advance and retard rollers 514, 516. For example, the advance and retard rollers 514, 516 may be made of microcellular foam and urethane but of course other suitable materials, such as rubber or plastic, may be used. Alternatively or additionally, each of the advance rollers 514 may be wider than the retard rollers 516 to provide the media item contact surfaces of each advance roller 514 with a greater contact area and therefore a higher coefficient of friction than the media item contact surfaces of the retard rollers 516.

As shown in FIGS. 4 and 5, a bunch of media items 410 is urged against the lower housing portion 304 of the media item separator 203 such that one or more media items 518 of the bunch 410 are at least partially received into the mouth 306 of the media item separator 302 and towards the advance and retarding rollers 514, 516. On engagement of the media items 518 with the advance and retarding rollers 514, 516, a top media item is urged away from the media items 518 by the advance rollers 514 which is being driven in a clockwise direction (as indicated by arrow A), whilst the remainder of the media items 518 are urged in the opposite direction by the retarding rollers 516 which are also being driven in a clockwise direction (indicated by arrow R) but which are located below the media items 518 so as to urge the media items from left to right as opposed the advance rollers 514 which urge a top media item from right to left. Therefore, in an advance mode of operation, the advance and retard rollers 514, 516 are being rotated in the same direction. In other words, the advance rollers 514 move a single media item forward along the transport path T whilst the lower retard rollers 516 prevent the remaining media items 518 of the bunch 410 from proceeding through the rollers 514, 516 and along the transport path T. For example, if two or more media items happen to enter the separation point between the advance and retard rollers 514, 516, the retard rollers 516 overcome an inter-item frictional force and reverse the direction of the bottom media item while allowing the top media item to continue along the transport path T. If media items are splayed in a manner where the lower media item has advanced in front of the top media item during feeding along the transport path T, the advance rollers 514 will pull the top media item forward while the retard rollers 516 will push the bottom media item in reverse to keep the correct order of the media items.

As shown in FIG. 5, a separated media item is advanced along a transport path (indicated by arrows T) towards an exit roller 520 mounted on an exit drive shaft 522 supported by the upper housing portion 302. The exit roller 520 urges the separated media item along the transport path T to exit an exit opening 524 of the separator 203 for further processing by the media item processing module 200. An ultrasonic sensor (not shown) is located downstream of the exit drive roller at an approximate located indicated by arrows S proximal to the exit opening 524 to detect when more than one media item has been erroneously separated from the bunch of media items 410 and is being transported along the transport path T for processing. On detection of multiple media items, a signal is sent from the sensor to a controller (not shown) which in turn reverses the direction of rotation of the advance roller 514 from a clockwise direction to an anticlockwise direction such that the advance and retarding rollers 514, 516 rotate in opposite directions to thereby reverse the direction of travel of the erroneous media items and return the erroneous media items to the bunch of media items 410 for reprocessing and re-separation.

As shown in FIG. 8, the upper housing portion 302 has a single rib portion 810 extending towards the lower housing portion 304 proximal to the opening 306 of the media item separator 203. In a similar manner, the lower housing portion 304 includes a pair of spaced apart rib portions 812 extending upwardly towards the upper housing portion 302 such that the single rib portion 810 of the upper housing portion 302 is located between the pair of rib portions 812 of the lower housing portion 304. These ribs aid in the straightening or stiffening of a limp media item in order for the media item to reach the separation/advance point between the advance and retarding rollers 514, 516 without curling or rolling over thereby preventing an undesirable media jam situation.

The media item separator according to certain embodiments of the present invention allows for a single media item to be removed from a bunch of media items with high accuracy and efficiency and a low separation fault rate which in turn reduces the risk of damage to media items. The media item separator according to certain embodiments of the present invention allows for the separation of single media items from a bunch of brand new media items where the frictional forces between each media item in the bunch is relatively high. For example, the media item separator allows for separation of a single media item from a bunch of brand new media items where there is an excessive build-up of fresh ink on each of the media items, such as currency notes. The media item separator allows for the separation of relatively limp media items. The staggered roller arrangement of the media item separator significantly reduces the wear of each of the advance and retarding drive rollers which in turn results in no or minimal maintenance/replacement of components in the media item separator and also maximizes the operating life of the separator. The performance of the media item separator is not compromised by degradation of the rollers surfaces with ink or dirt for example. In certain embodiments, there is no contact pinch force between rollers, instead the deflection of the document provides the separating force.

Throughout the description and claims of this specification, the words "comprise" and "contain" and variations of them mean "including but not limited to" and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of the features and/or steps are mutually exclusive. The invention is not restricted to any details of any foregoing embodiments. The invention extends to any novel one, or novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

What is claimed is:

1. Apparatus for separating a media item from a bunch of media items, comprising:

a plurality of first rollers located on a first side of a transport path along which a media item is transported, the first rollers supported by an upper housing portion of the apparatus and the first rollers are advance rollers, wherein the upper housing portion includes a single rib portion extending towards a lower housing portion, and wherein the lower housing portion includes a pair of spaced apart rib portions extending outwardly towards the upper housing portion, the single rib portion located between the pair of rib portions, the single rib portion and the pair of rib portions configured to aid in straightening or stiffening the media item for the media item to reach a separation/advance point between the first rollers and at least two further rollers;

the at least two further rollers located on a further side of the transport path opposite the first side, the at least two further rollers supported by the lower housing portion of the apparatus and the at least two further rollers are retard rollers, and wherein each of the first rollers are wider than each of the at least two further rollers for providing greater contact area with the media item than the at least two further rollers, said at least two further rollers being spaced apart to vertically receive a portion of said first rollers therebetween, and wherein the first rollers do not contact the at least two further rollers, and the first rollers and the at least two further rollers opposing and staggered from one another on opposite sides of the transport path and deforming the media item into a wave profile, wherein a first shaft supports the first rollers and a second shaft supports the at least two further rollers, and a media contact surface of the first rollers is made of a different material from a media contact surface that the at least two further rollers are made of; and a controller, wherein in an advance mode of operation said first and further rollers rotate, by direction of the controller, in the same direction and in a reject mode of operation said first and further rollers rotate, by direction of the controller, in opposite directions.

2. The apparatus as claimed in claim 1, wherein a parameter associated with the first rollers are greater than a corresponding parameter associated with the at least two further rollers.

3. The apparatus as claimed in claim 2, wherein each of the first and further rollers provides a respective media item contact surface and said parameter comprises a coefficient of friction of the respective contact surfaces.

4. The apparatus as claimed in claim 1, further comprising:

said first rollers comprise a first set of spaced apart rollers rotatable about a first common axis; and said at least two further rollers comprise a further set of spaced apart rollers rotatable about a further common axis; wherein the first common axis is substantially parallel with and spaced apart from the further common axis and a combined media item contact surface of said first set of rollers is set apart from a corresponding combined media item contact surface of said further set of rollers.

5. The apparatus as claimed in claim 4, wherein said first set of rollers is staggered with respect to said further set of rollers so that rollers of the first and further sets of rollers mesh together to deform media items transported therebetween.

6. The apparatus as claimed in claim 1, further comprising:

a slotted opening in a housing to at least partially receive a plurality of media items of a bunch of media items, the slotted opening comprising opposed and spaced apart first and further lip portions; wherein at least a one of said first and further lip portions is tapered inwardly with respect to the slotted opening to partially separate and guide a media item when the bunch of media items is urged towards said housing.

7. The apparatus as claimed in claim 6, further comprising:

a one of the first and further lip portions comprises at least one first protrusion extending into the slotted opening and a remainder one of the first and further lip portions comprises at least two further protrusions extending into the slotted opening; wherein the at least two further protrusions are spaced apart in a staggered pattern with respect to the at least one first protrusion.

8. The apparatus as claimed in claim 1, further comprising:

at least one sensor for sensing when a plurality of media items have been separated simultaneously from the bunch of media items; and the controller that selectively rotates said first rollers in an opposite direction to said further rollers responsive to said at least one sensor to return the plurality of media items to the bunch of media items in said reject mode of operation.

9. A media item processing module comprising the apparatus as claimed in claim 1.

10. A method of separating a media item from a bunch of media items, comprising:

in an advance mode of operation, rotating, by a controller of a Self-Service Terminal (SST), first rollers supported by an upper housing portion of a media separator integrated into the SST as advance rollers and a media item contact surface of the advance rollers made of a first material, located on a first side of a transport path along which a media item is transported and at least two further rollers located on an opposite side of the transport path and spaced apart to vertically receive a portion of first rollers therebetween, in a same direction, the further side of the transport path being opposite the first side, the at least two further rollers supported by a lower housing portion of the media separator as retard rollers with a media item contact surface of the retard rollers made of a different material from the first material, and wherein each of the first rollers are wider than each of the at least two further rollers supporting a greater contact area for any transported media item by the first rollers than the at least two further rollers, and straightening or stiffening the media item as the media item approaches a separation/advance point between the first rollers and the at least two further rollers through a single rib portion of the upper housing portion that extends towards the lower housing portion and a pair of rib portions extending upwardly towards the upper housing portion, the single rib portion located between the pair of rib portions, and wherein the first rollers do not contact the at least two further rollers, and wherein the first rollers and the at least two further rollers opposing and staggered from one another on opposite sides of the transport path and deforming the media item into a wave profile, and wherein a first shaft supports the first rollers and a second shaft supports the at least two further rollers; and in a reject mode of operation, rotating, by the controller of the SST, said first and further rollers in opposite directions.

11. The method as claimed in claim 10, further comprising:

via said first rollers, separating, by the controller of the SST, a media item from a bunch of media items; and urging, by the controller of the SST, said media item over said further rollers and along said transport path; wherein said first rollers comprise a media item contact surface having a greater coefficient of friction than a corresponding media item contact surface of said further rollers.

12. The method as claimed in claim 10, further comprising:

deforming, by the controller of the SST, a plurality of media items located on a transport path between said first and further rollers; and separating, by the controller of the SST, a media item from said plurality of media items.

13. The method as claimed in claim 10, further comprising:

urging, by the controller of the SST, a bunch of media items against a tapered lip portion of a slotted opening in a housing to partially advance at least one media item of said bunch of media items into said opening and towards the first and further rollers.

14. The method as claimed in claim 10, further comprising:

sensing, by the controller of the SST, a plurality of media items simultaneously separated from a bunch of media items being moved together downstream of said first and further rollers with respect to the transport path; and reversing, by the controller of the SST, a direction of rotation of said first rollers so that said first rollers rotate in a different direction to said further rollers to thereby return the sensed plurality of media items to the bunch of media items in said reject mode of operation.

15. A method of separating a media item from a bunch of media items, comprising:

via first drive members rotating, by a controller of a Self-Service Terminal (SST), in a first direction, advancing a one media item from a bunch of media items, the first drive members supported by an upper housing portion of a media separator integrated within the SST and media item contact surface of the first drive members made of a first material;

via further drive members rotating, by the controller of the SST, in the first direction, substantially preventing any advancement of a remaining media item advanced from the bunch with said a one media item, wherein the further drive members supported by a lower housing portion of the media separator and a media item contact surface of the retard rollers made of a different material than the first material, and wherein each of the first drive members is wider than each of the second drive members supporting a greater contact area with the advancing media item than the further driver members, and wherein the first driver members do not contact the further driver members, and wherein the first drive members and the further drive members are staggered from one another on opposite sides of the media items and the further drive members vertically receive the first drive members in a spacing of the further drive members deforming the media items into a wave profile, and wherein a first shaft supports the first drive members and a second shaft supports the further drive members; and straightening or stiffening the media item as the media item approaches a separation/advance point between the first drive members and the further drive members through a single rib portion of the upper housing portion that extends towards the lower housing portion and a pair of rib portions extending upwardly towards the upper housing portion, the single rib portion located between the pair of rib portions.

* * * * *